United States Patent [19]

Fischer

[11] 4,035,863

[45] July 19, 1977

[54] SWIMMING POOL BRUSH GUIDE

[76] Inventor: Albert Fischer, 4835 Oakway Drive, San Antonio, Tex. 78228

[21] Appl. No.: 750,010

[22] Filed: Dec. 13, 1976

[51] Int. Cl.[2] ..... A46B 17/02; E04H 3/20

[52] U.S. Cl. ..... 15/160; 15/1.7; 15/257 R

[58] Field of Search ..... 15/1.7, 257 R, 160, 15/162; 254/134 FT, 134 R, 190 R, 190 C, 190 D; 269/1 R; 248/110

[56] References Cited

U.S. PATENT DOCUMENTS

| | | | |
|---|---|---|---|
| 307,986 | 11/1884 | Porritt | 254/190 R |
| 462,983 | 11/1891 | Martin | 254/190 R |
| 3,351,968 | 11/1967 | Masters | 254/190 C X |

FOREIGN PATENT DOCUMENTS

| | | | |
|---|---|---|---|
| 2,023,593 | 11/1971 | Germany | 15/1.7 |

*Primary Examiner*—Edward L. Roberts
*Attorney, Agent, or Firm*—John C. Stahl

[57] ABSTRACT

A swimming pool brush guide comprising a base plate and roller assembly adapted for use in combination with a swimming pool brush including a long handle; the base plate is placed on the walkway and/or coping with said roller assembly at least partially extending inwardly of the side wall of the pool; the user stands on said base plate, grasps the handle of said brush and forces the same outwardly against said roller assembly whereby the remote end of said brush is forced inwardly against the side wall of said swimming pool.

10 Claims, 5 Drawing Figures

SWIMMING POOL BRUSH GUIDE

BACKGROUND OF THE INVENTION

As described in detail in U.S. Pat. No. 3,402,413, it is difficult, standing on the edge of a swimming pool, to maintain sufficient force on a swimming pool brush to insure that the bristles intimately contact the wall surfaces. To remedy this situation, wings and planes have heretofore been attached to the brush or handle for exerting force against the brush as it is moved through the water. In general, these prior art devices are relatively inefficient and considerable difficulty is experienced in their use, especially on the upstroke.

SUMMARY OF THE INVENTION

The primary object of the invention is the provision of a swimming pool brush guide used in combination with a conventional swimming pool brush whereby the user may exert a desired force on the brush against the side walls of a swimming pool.

Another object is to provide such a brush guide which is not readily affected by the chemicals normally used in treating the water and cleaning swimming pools.

Still another object is to provide such a brush guide which is relatively simple in construction, inexpensive to manufacture, easy to use, and universal in its adaptability.

Other objects and features of the invention will become apparent to those skilled in the art from a consideration of the following specification when read in the light of the annexed drawings.

DESCRIPTION OF PREFERRED EMBODIMENTS

Figure 1:
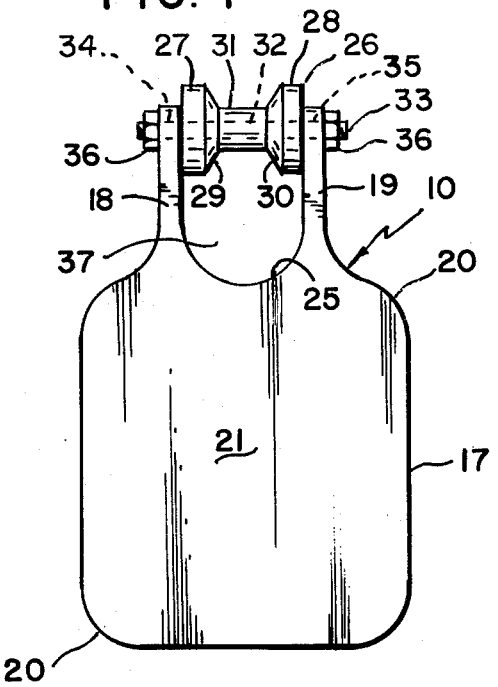
FIG. 1 is a top plan view of a preferred embodiment of swimming pool brush guide of the subject invention.
Figure 2:
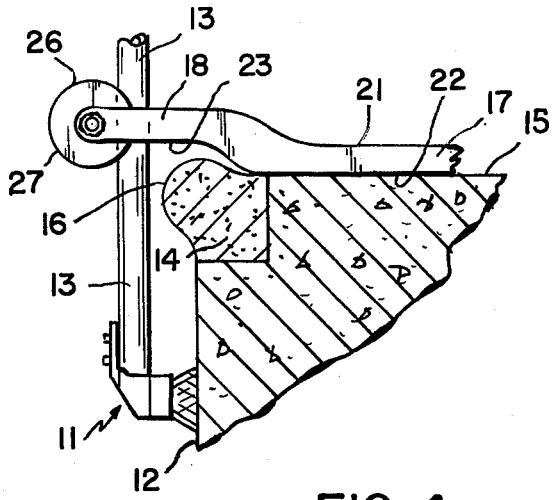
FIG. 2 is a fragmentary, side elevational view of the swimming pool brush guide of FIG. 1 placed upon the walkway of a swimming pool with a swimming pool brush carried therein.

Referring now to the drawings, wherein like reference numerals designate like or corresponding parts throughout the several views, there is shown in FIGs. 1–2 a preferred embodiment of swimming pool brush guide 10 adapted to be used in combination with a conventional swimming pool brush 11 for cleaning a swimming pool wall 12 or the like.

Brush 11 of desired width is fixedly or detachably secured to one end of an elongated handle 13 of tubular or solid stock. As is well known in swimming pool construction, coping 14 is normally secured at least partially about the swimming pool in the exterior angle formed between the upper side wall of said pool and walkway 15 which extends at least partially about said pool. The coping illustrated in FIG. 2 includes edge 16 which is generally semi-circular in transverse section and terminates upwardly at least slightly above the plane of the walkway; the raised edge may conveniently be grasped by a swimmer and additionally prevents waste water from flowing into said pool.

Brush guide 10, molded of a metallic or plastic composition which desirably exhibits non-corrosive properties and is not deleteriously affected by the chemicals normally used in treating the water and cleaning swimming pools, comprises base plate 17 and integrally formed, longitudinally extending and laterally spaced arms 18–19 of desired length. Base plate 17 is oblong with its length substantially greater than its width, and is of uniform thickness; desirably said plate is of sufficient size to permit the user to stand with both feet placed thereon. As indicated by reference numeral 20, the corners of said base plate are desirably radiused. Selected portions of top 21 of said base are scored, sandblasted or otherwise provided with a rough or anti-slip surface; bottom 22 of said plate is conventionally provided with an anti-skid surface when placed on wet concrete or tile.

Arms 18, 19 extend angularly upward in proximity to the foremost end of plate 17 and then forwardly with the lower surfaces 23–24 (surface 24 not shown) of the respective arms transversely aligned and lying in the approximate plane of the top of said base plate. It is understood that the lower surfaces 23, 24, of arms, 18, 19 may be any desired vertical distance above the bottom of plate 17 and desirably at least such distance to permit the arms to pass above the upper edge of the coping. As indicated by reference numeral 25, the foremost edge of the plate intermediate arms 18, 19 is generally concave.

Roller 26 of hard rubber or plastic composition is rotatably mounted intermediate the approximate foremost ends of arms 18, 19 and at least slightly spaced from the innermost sides thereof. More specifically, roller 26 terminates laterally in cylindrical sections 27–28 of desired diameter and width which bound inwardly converging shoulders 29–30 and cylindrical central section 31 of reduced diameter; axial bore 32 passes through said roller and carries shaft 33. Transversely aligned bores 34–35 in proximity to the foremost ends of arms 18–19, respectively, accommodate the ends of said shaft with nuts 36 threaded on the opposing ends of said shaft outwardly of each respective arm. It is understood that washers of non-corrosive metallic or plastic composition may be carried on shaft 33 outwardly of roller 26. Furthermore, a hollow cylindrical sleeve of metallic or plastic composition may be inserted in bore 32 with shaft 33 journaled therein. Alternately, a flanged sleeve may be inserted in at least the outer ends of bore 32 and said shaft carried therein. Cylindrical sections 27, 28 of said roller desirably terminate downwardly at least slightly above the plane of the bottom of said base plate.

Prior to use the handle 13 of brush 11 is passed upwardly through opening 37 bounded by arms 18–19, concave edge 25 and roller 26. Base plate 17 is then placed on the walkway 15 and/or coping 14 in such a manner that cylindrical section 31 of said roller is at least slightly inwardly of the vertical plane of the side wall of the swimming pool. The user then places one or both feet on said base plate, grasps a selected portion of handle 13 and applies an outward force against said handle whereby a lower portion of said handle bears against section 31 of roller 26 and brush 11 on the remote end of said handle is forced inwardly against the side wall of the pool. Handle 13 is then raised and lowered in a scrubbing motion while continuing to force said handle outwardly against said roller thereby applying a desired force at a desired angle against said pool wall. Dependent upon the width of the brush, approximately 2–3 feet on either side of brush guide 10 may be cleaned before repositioning the guide to scrub the next adjacent section of the side wall of the pool.

Figure 4:
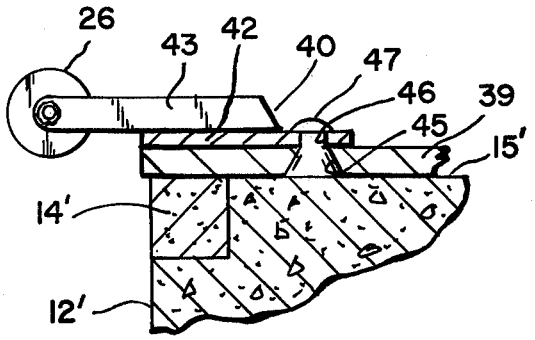
FIG. 4 is a fragmentary, side elevational view of the embodiment of FIG. 3 placed upon the coping and walkway of a swimming pool.
Figure 3:
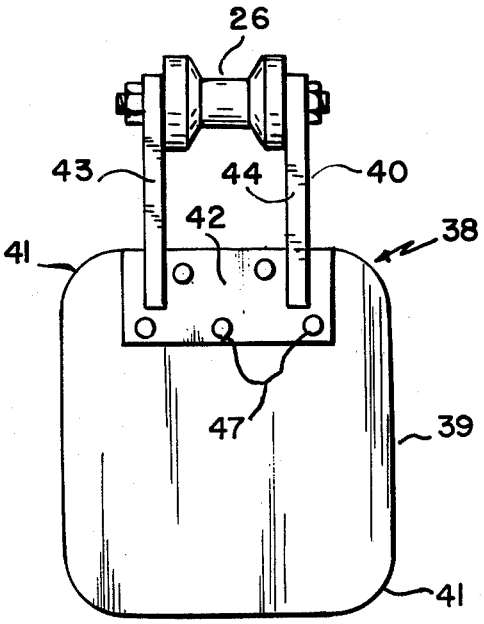
FIG. 3 is a top plan view of another embodiment of swimming pool brush guide.

There is shown in FIGS. 3–4 another embodiment of swimming pool brush guide 38 comprising base plate 39 and roller assembly 40 which may be used in connection with swimming pools where the upper surfaces of the coping and walkway are flat. Specifically, coping 14' is generally rectangular in transverse section and is secured in the exterior angle formed between swimming pool wall 12' and walkway 15' with the flat upper surface of coping 14' aligned with the corresponding surface of said walkway.

Base plate 39, of non-corrosive metallic or plastic composition, is generally oblong with its length substantially greater than its width, and is of uniform thickness; desirably the corners of said base plate are radiused, indicated by reference numeral 41. Rectangular plate 42 of non-corrosive metallic or plastic composition is substantially smaller than base plate 39; arms 43–44 of bar stock or the like and of desired length are fixedly secured rearwardly to plate 42, said arms parallel the major axis of plate 42 and are laterally spaced with roller 26 rotatably mounted intermediate the approximate outer ends thereof in the manner heretofore described. The foremost edge of plate 42 is desirably vertically aligned with the corresponding edge of base plate 39 and is detachably or fixedly secured to selected portions thereof. As shown in FIG. 4, a plurality of countersunk bores 45 are provided in selected positions in base plate 39 with aligned bores 46 in plate 42; rivets 47 are passed upwardly through said bores and expanded. Alternatively, plate 42 may be detachably secured to the corresponding portions of the base plate in the manner illustrated in FIG. 5 of the drawings.

Figure 5:
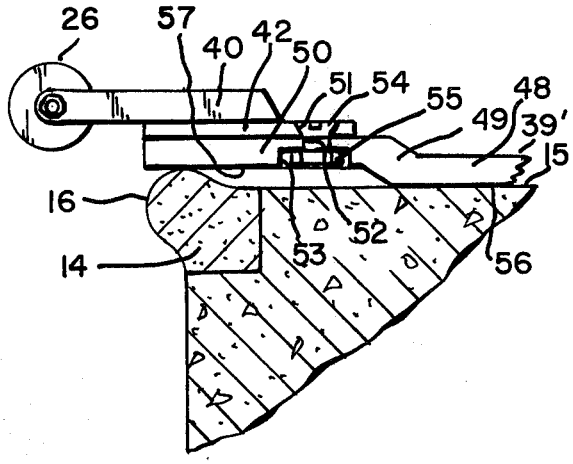
FIG. 5 is a fragmentary, side elevational view of a modification of the embodiment of FIGS. 3–4 placed upon the walkway and partially supported by the coping of a swimming pool.

There is shown in FIG. 5 a modification of the embodiment of FIGS. 3–4 wherein at least the foremost portion of base plate 39' is stepped or otherwise shaped. More specifically, base plate 39' is of integral construction and generally oblong comprising a relatively large rectangular rear section 48, angularly inclined intermediate section 49 forwardly thereof, and foremost section 50 which is rectangular in plan with its minor axis paralleling that of section 48 and vertically thereabove. Section 42 of the roller assembly 40 is fixedly secured to section 50 of the base plate in the manner heretofore illustrated and described in connection with FIG. 4 of the drawings, or alternatively, detachably secured thereto. Specifically, a plurality of countersunk bores 51 in selected positions in plate 42 communicate downwardly with bores 52 and recesses 53 in section 50 of said base plate with a bolt 54 inserting in each bore 51 and threading into a nut 55 carried in recess 53. In use, bottom 56 of section 48 is supported on the walkway of the pool while bottom 57 of section 50 bears against the upper edge of the coping whereby the roller assembly 40 extends substantially inwardly of the wall of the swimming pool.

Selected portions of the upper and lower surfaces of base plate 39 and the corresponding surfaces of section 48 of base plate 39' are conventionally provided with anti-slip and anti-skid properties, respectively.

It should be understood, of course, that the foregoing disclosure relates to only preferred embodiments of the invention and that it is intended to cover all changes and modifications of the invention herein chosen for the purposes of the disclosure which do not constitute departures from the spirit and scope of the invention.

What is claimed is:

1. In combination with a swimming pool brush including a long handle adapted to clean the side wall of a swimming pool, a swimming pool brush guide comprising a base plate, first and second laterally spaced and forwardly extending arms integrally formed on said base plate, a roller rotatably mounted intermediate said first and second arms, said handle of said brush adapted to be carried intermediate said arms and said roller with said brush extending downwardly, said brush guide adapted to be positioned adjacent said swimming pool with said roller extending at least slightly inwardly of said side wall whereby a user, standing upon said base plate, grasps said handle, forces the same outwardly against said roller, and said brush is forced inwardly against the side wall of said pool.

2. The invention of claim 1 wherein said base plate includes a top surface including means thereon to minimize slipping.

3. The invention of claim 1 wherein said base plate includes a bottom surface including means thereon to minimize sliding.

4. The invention of claim 1 wherein said arms extend angularly upward from said base plate and thence forwardly, paralleling the major plane of said base plate.

5. In combination with a swimming pool brush including a long handle adapted to clean the side wall of a swimming pool, a swimming pool brush guide comprising a base plate and a roller assembly secured to said base plate, said roller assembly including a plate, first and second forwardly extending and laterally spaced arms, and a roller rotatably mounted intermediate said arms, said handle of said brush adapted to be carried intermediate said arms and said roller with said brush extending downwardly, said brush adapted to be positioned adjacent said swimming pool with said roller extending at least slightly inwardly of said side wall whereby a user, standing upon said base plate, grasps said handle, forces the same outwardly against said roller, and said brush is forced inwardly against the side wall of said pool.

6. The invention of claim 5 wherein said base plate is essentially flat.

7. The invention of claim 5 wherein said base plate is essentially rectangular in plan and includes a transversely extending rear section, an angularly inclined section forwardly thereof, and a transversely extending foremost section paralleling said rear section, said plate of said roller assembly secured to the foremost section of said base plate.

8. The invention of claim 5 wherein said roller comprises laterally spaced cylindrical sections, inwardly converging shoulders, a central cylindrical section of reduced diameter, and an axially extending bore through said roller for mounting said roller intermediate said arms.

9. The invention of claim 8 further including a hollow cylindrical sleeve in said bore of said roller, a shaft carried in said sleeve and adapted to pass through transversely aligned bores in said arms and secured thereto.

10. The invention of claim 9 further including washers carried on said shaft intermediate said roller and said arms.

* * * * *